US007467590B1

(12) United States Patent
Meller

(10) Patent No.: US 7,467,590 B1
(45) Date of Patent: Dec. 23, 2008

(54) BUCKET MOUNTED TABLETOP

(75) Inventor: Peter Joseph Meller, Spingfield, MO (US)

(73) Assignee: Peter J. Meller, Springfield, MO (US)

( * ) Notice: Subject to any disclaimer, the term of this patent is extended or adjusted under 35 U.S.C. 154(b) by 0 days.

(21) Appl. No.: 11/985,022

(22) Filed: Nov. 13, 2007

(51) Int. Cl.
*A47B 13/08* (2006.01)

(52) U.S. Cl. ..... 108/90; 297/188.09

(58) Field of Classification Search ..... 108/42, 108/25, 26, 90; 297/175, 176, 177, 178, 297/179, 256.16, 188.08, 188.09
See application file for complete search history.

(56) References Cited

U.S. PATENT DOCUMENTS

| | | | | | |
|---|---|---|---|---|---|
| 1,292,980 | A | * | 1/1919 | Fry | 248/213.2 |
| 4,041,964 | A | * | 8/1977 | Shamoon | 108/26 |
| 4,295,680 | A | * | 10/1981 | Grasso | 297/188.09 |
| 4,379,587 | A | * | 4/1983 | Duncan | 297/188.09 |
| 4,436,340 | A | * | 3/1984 | Hernandez | 297/188.09 |
| 4,760,802 | A | * | 8/1988 | Leong | 108/157.16 |
| 4,846,076 | A | | 7/1989 | Menges, Sr. et al. | |
| D321,991 | S | * | 12/1991 | Menges et al. | D6/335 |
| 5,211,294 | A | * | 5/1993 | Garman | 211/70.6 |
| 5,586,805 | A | * | 12/1996 | Rinehart | 297/188.09 |
| 5,938,276 | A | * | 8/1999 | Munoz et al. | 297/188.08 |
| 6,148,737 | A | * | 11/2000 | Bowman et al. | 108/42 |
| 6,745,702 | B2 | * | 6/2004 | Goldberg et al. | 108/26 |
| 7,322,300 | B2 | * | 1/2008 | Caeton | 108/90 |

* cited by examiner

*Primary Examiner*—José V Chen

(57) ABSTRACT

A portable tabletop for use while mounted atop a convention bucket is disclosed. The tabletop contains integrated recess forming semi-circular projections for receiving the annular projection or lip of a conventional bucket. The recess is sufficiently deep and reinforced to securely attach the tabletop to a bucket allowing it to support multiple items. An opening in the center of the tabletop allows for the retrieval of items from, or the discarding of items into, the interior of a bucket while the tabletop is mounted in place on a bucket. Additionally, when not mounted on a bucket, the opening aids in the portability of the tabletop by allowing a person to grip the center of the device and carry it one-handed parallel to the body. The tabletop also incorporates slot shaped openings, which allow the bail of the bucket to protrude vertically through the tabletop providing for the tabletop and bucket to be easily moved as a whole while the tabletop is mounted in place. The tabletop is preferably made of a single piece of high-density polyethylene material.

1 Claim, 3 Drawing Sheets

BUCKET MOUNTED TABLETOP

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

The present invention relates generally to a tabletop, and more particularly to a portable tabletop for use while mounted atop a conventional bucket.

2. Prior Art

It has been a general practice to employ conventional buckets in a myriad of activities after their original contents have been removed. Many of these activities such as fishing, gardening, painting, camping, tile laying, etc. would also benefit from being performed with the aid of a table. Tables however, are often not readily available and hence objects with flat or somewhat flat surfaces are used instead. For example, when fishing, whether in a boat or from land, having a table would be advantageous in performing tasks such as measuring fish, rigging lines, cleaning fish, preparing lunch, etc. Due to the lack of readily available tables when fishing, the ground, a board, or even boat seats are commonly used as alternatives. Conversely, buckets are often readily available when fishing as they are frequently used for holding fish, bait, or tackle.

Activities which involve eating outdoors, such as camping and picnicking, often suffer due to a lack of available and convenient tables for holding food, beverages, gear, etc. Again, these are activities where buckets are frequently present due to their regular use as storage containers and furthermore as trash receptacles after their contents have been removed. In the absence of adequate tabletop space, coolers, automobile hoods, lowered truck tailgates, chairs, and the ground are commonly used substitutes.

Using items as tables which were not designed to be used as tables presents drawbacks during many activities. Cleaning fish on a boat seat or a board can be hazardous, messy, and difficult. Using a cooler as a table requires removing all items from atop the cooler in order to access its interior. Sitting items on the ground provides easy access for insects and can expose them to dirt and moisture. What is needed is a portable tabletop designed to be used in conjunction with a conventional bucket without denying access to the interior of the bucket whilst also providing ample surface area to be sufficiently useful in a multitude of activities.

The prior art reveals a device disclosed in U.S. Pat. No. 4,846,076 dated Jul. 11, 1989 to Menges, Sr. et al., that can be used as a small table while mounted on top of a bucket. However, this patent describes a device designed specifically for use by an individual as a cutting board for cleaning fish and as a seat while fishing. A disadvantage of this device is that its surface area is very small thereby making the device unsuitable for many activities where a larger surface is needed. Another disadvantage of this device is that by not mounting centrally over the bucket the engaging portions of the bucket and device are mitigated resulting in a less secure attachment of the device to the bucket.

U.S. Pat. No. 1,292,980 dated Jan. 28, 1919 to W. T. Fry discloses a small holder that can be attached to a bucket for the purpose of holding a brush and for wiping excess material from a brush. A disadvantage of this device is its very small size, which makes it unsuitable to hold many objects at once or even single objects much larger than a paintbrush.

SUMMARY OF THE INVENTION

The present invention incorporates the realization that a tabletop used in conjunction with a conventional bucket would be advantageous in many activities. The preferred embodiment of the invention provides a tabletop adapted for use in connection with a cylindrically shaped bucket, the tabletop being in form of a planar platform member having a circular aperture in the central region thereof for providing access to the interior of the bucket. Said circular aperture being joined by two slot-shaped apertures extending beyond the diameter of the bucket rim thusly allowing the bail of the bucket to protrude vertically through the tabletop. By allowing the bail to pass through the tabletop, the slot-shaped apertures act to facilitate transportation of the bucket and tabletop as one entity in the normal manner a bucket is carried by a person. When the tabletop is not mounted on a bucket the circular aperture also facilitates transportation by allowing an individual to grip the edge of the aperture with one hand and carry the tabletop parallel to the body.

The tabletop of the present invention has a flat upward facing surface and a downward facing surface which features integrated semi-circular projections forming a recess for receiving the rim of a bucket in the same way that a conventional bucket lid would receive the rim of a bucket. Said projections also possessing radial vanes in order to strengthen both the interior and exterior walls of the recess thereby compensating for the loss of hoop strength resulting from said projections not forming a complete circle due to their bisection by the slot apertures. The tabletop being preferably rectangular in shape and providing a large, sturdy, surface able to be utilized advantageously by one or more persons in a variety of activities.

An object of the present invention is to provide a tabletop for mounting on top of a conventional bucket.

Another object of the present invention is to provide a tabletop, as aforesaid, with a surface area large enough to be useful in many activities.

Yet another object of the present invention is to provide a tabletop, as aforesaid, with a surface area that can be easily utilized by more than one person simultaneously.

Yet another object of the present invention is to provide a tabletop, as aforesaid, that is readily portable.

Yet another object of the present invention is to provide a tabletop, as aforesaid, which allows the interior of the bucket to be utilized when said tabletop is mounted in place.

It is further an object of the present invention to minimize cost of manufacture and maximize durability by way of simplistic design.

These and other objects will become apparent, as will a better understanding of the concepts underlying the present invention, by reference to the following description, which is to be taken in conjunction with the accompanying drawings in which a presently preferred embodiment of the invention is illustrated by way of example. It is to be expressly understood, however, that the drawings are for the purpose of illustration and description only, and are not intended as a definition of the limits of the invention.

DETAILED DESCRIPTION OF THE PREFERRED EMBODIMENT

During the course of this description, like numbers will be used to identify like elements according to the different views which illustrate the invention.

Figure 1:
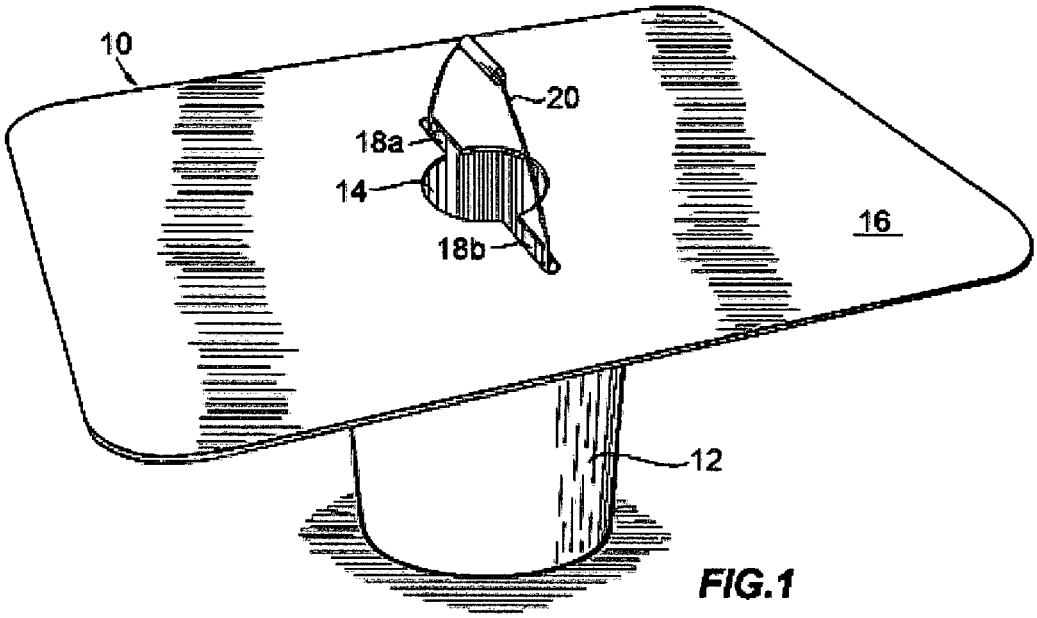
FIG. 1 is a perspective view of the present invention as it appears when mounted atop a conventional bucket.
Figure 2:
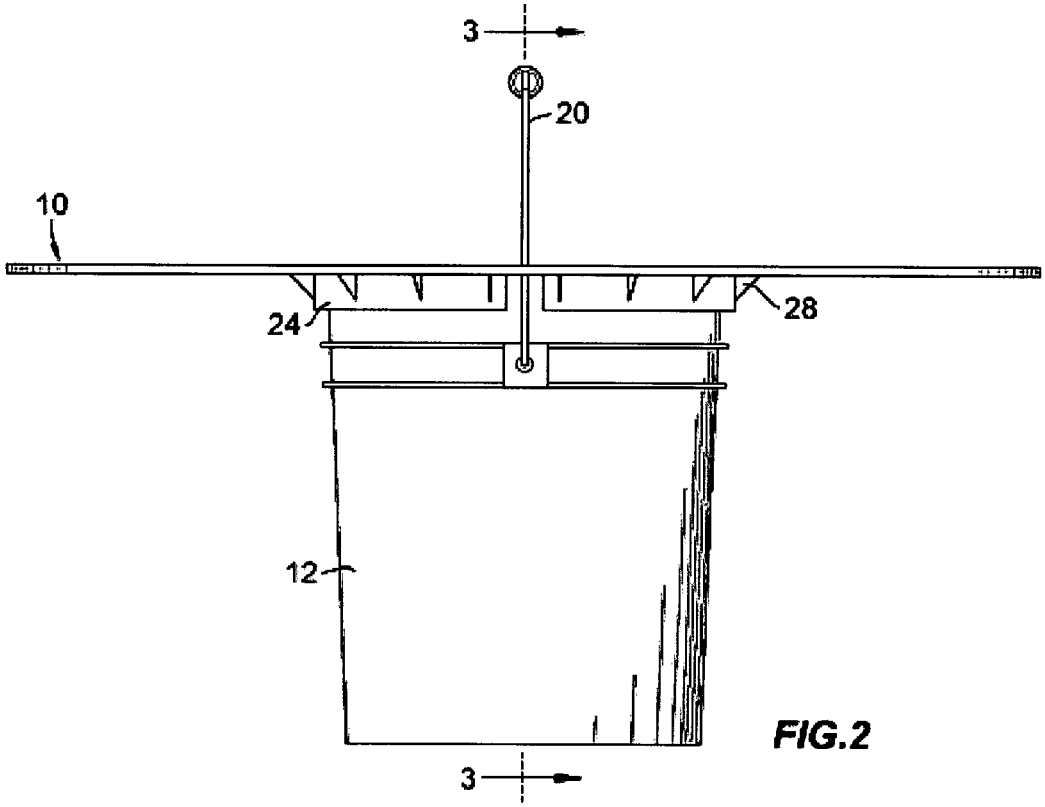
FIG. 2 is a side elevational view of the present invention mounted atop a conventional bucket.
Figure 3:
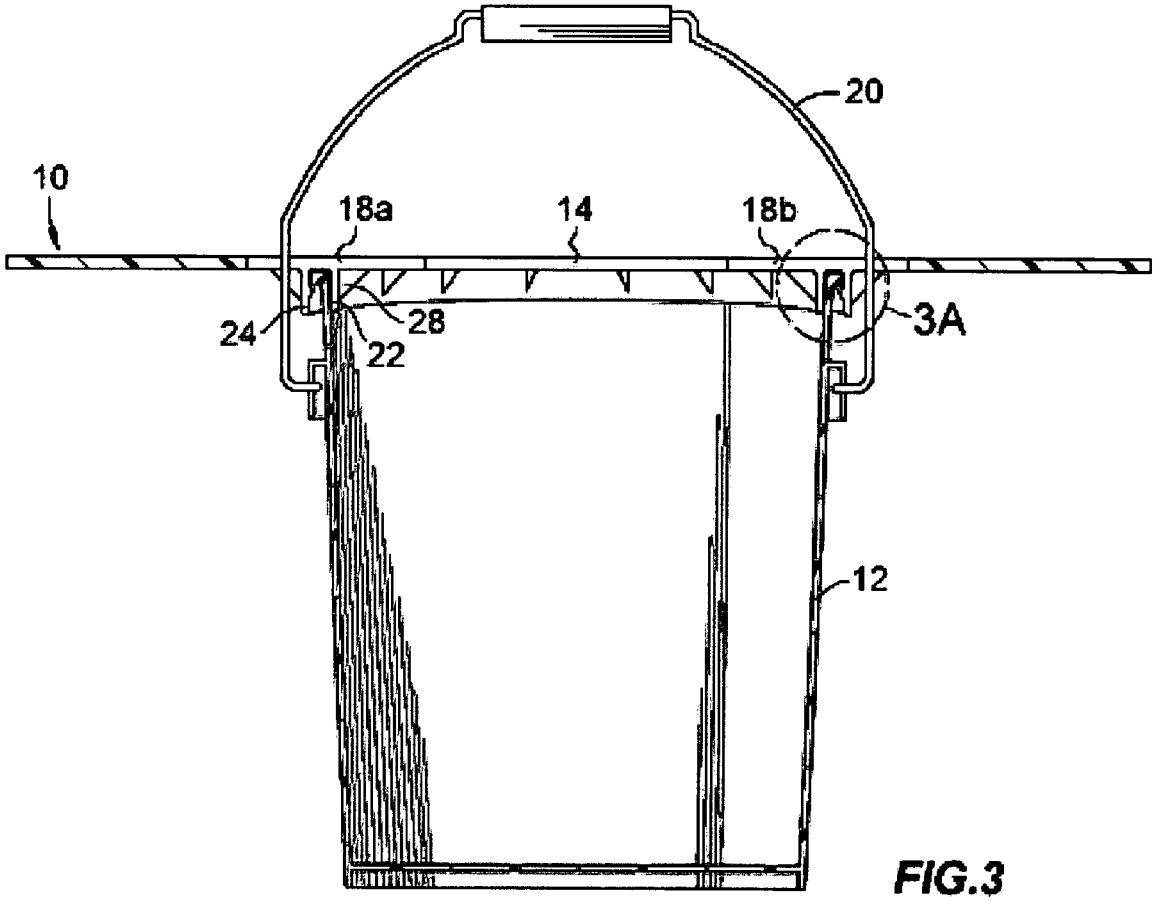
FIG. 3 is a cross-sectional view of the present invention mounted atop a conventional bucket taken along line 3-3 of FIG. 2.

Referring to FIGS. 1, 2 and 3 the bucket mountable tabletop invention 10 according to the preferred embodiment thereof is shown in the operating position mounted on a conventional bucket 12. The bucket 12 is of the type often originally containing paint, plaster, food stuffs, etc. they are frequently obtained with little or no charge and are employed for various uses since they would otherwise be disposed of. Such buckets typically have a height of 14¼" and a diameter of 11¼" on the open rim. The invention 10 does not completely obscure access to the interior of the bucket 12, rather it provides a circular opening 14 positioned centrally over the rim of the bucket for access to the interior of the bucket 12. The opening 14 is preferably 5½" and is joined on opposite sides with ½" wide slot shaped openings 18*a* and 18*b* which extend ¾" beyond the rim of the bucket 12 to allow the bail 20 to remain in an upright position while the table is mounted in position. Said slot shaped openings 18*a* and 18*b* thereby permit the bucket 12 and invention 10 to be moved as a single entity with no separation required.

Figure 4:
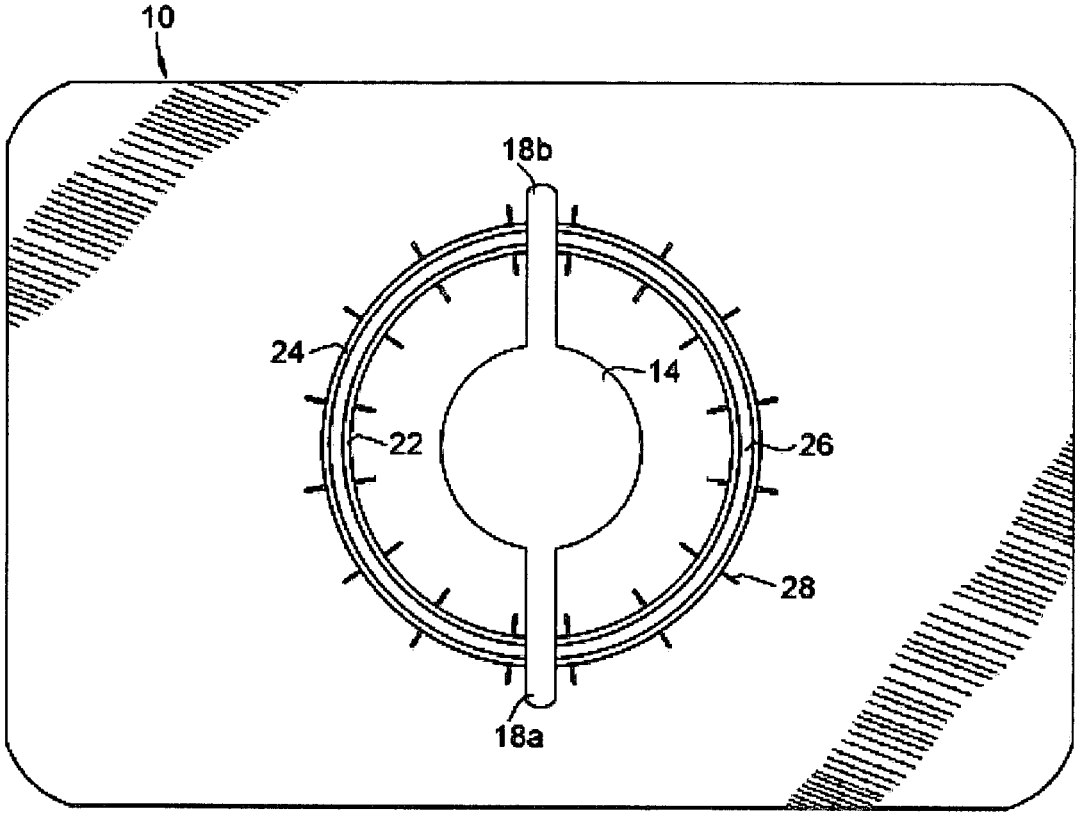
FIG. 4 is a bottom view of the present invention.

As shown in FIG. 4 a semicircular inner projection 22 and outer projection 24 are located on the bottom surface of the invention 10 providing a bucket rim engaging recess 26 to be occupied by the bucket lip in a sealed relationship. It will be noted that the inner projection 22 and outer projection 24 would form complete circles where it not for the presence of the slot shaped openings 18*a* and 18*b* and are identical on either side of the slot openings. The inner projection 22 preferably has a radius of 5½" is ⅛" thick and protrudes ¾" from the bottom surface of the invention 10. The outer projection 24 preferably has a radius of 5 15/16" is ⅛" thick and protrudes ⅞" from the bottom surface of the invention 10. Both projections preferably possess an arc length of approximately 175°.

Figure 3A:
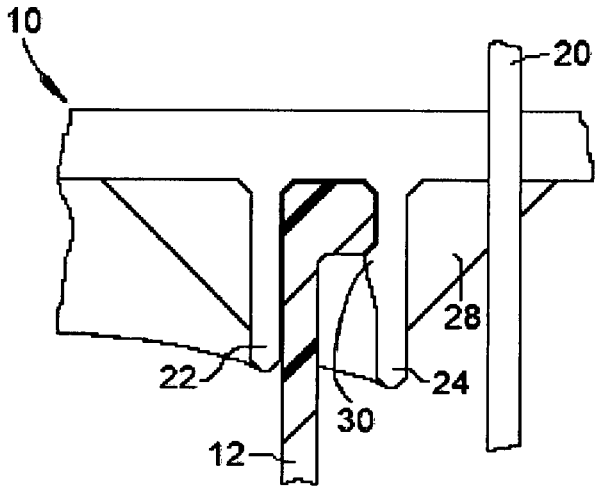
FIG. 3A is an enlarged view of the contacting features of the present invention and the bucket taken generally from circle 3A of FIG. 3.

FIG. 3 best shows the relationship of the invention 10 to the top of the bucket 12 when the invention is mounted on a bucket. As is detailed in FIG. 3A the outer projection 24 contains a continuous 1/16" inward extending projection 30 to engage and retain the bucket lip. It will also be noted that numerous radial support vanes 28 are present on the exterior of the outer projection 24 and the interior of the inner projection 22 to provide strength and rigidity to the projections. Preferably the support vanes 28 are located 24° degrees apart but could vary with the realization that greater separation allows for fewer vanes resulting in decreased support to the projections and, conversely, less spacing results in more vanes and greater support. Support vanes are preferably evenly distributed outward from the midpoint on each semicircular projection. The invention 10 is preferably made of a single piece of high-density polyethylene material.

Finally, it should be understood that while a preferred embodiment has been described herein, any variety of suitable materials of construction and dimensions may be used to satisfy the particular needs and requirements of the end user. It will be apparent to those skilled in the art that various modifications and variations can be made in the design and construction of a bucket mounted tabletop without departing from the scope or spirit of the present invention.

The invention claimed is:

1. A portable tabletop suitable for supporting various objects when mounted on the open end of a substantially cylindrically shaped conventional bucket, the bucket including a circular opening possessing a lip, a bail spanning the opening, and a hollow compartment inside, the tabletop comprising:

(a) a substantially planar member adapted for generally horizontal positioning possessing an upper working surface encompassing an area greater in diameter than the width of the bail of the bucket;

(b) said planar member possessing a substantially centrally located aperture whereby allowing access to the interior of the bucket;

(c) said centrally located aperture being conjoined on opposite sides by two slot shaped apertures thereby forming an aperture of width in excess of that of the bail of the bucket whereby allowing the upright bail to pass vertically through said planar member when said planar member is positioned on the bucket with the elongated sides of the bail aligned parallel between the elongated sides of the slots thereby facilitating movement of the bucket and said planar member in unison;

(d) semicircular adjacent walls, positioned concentrically around said central aperture with ends abutting said slot shaped apertures, extending downwardly from the bottom side of said planar member, the outer walls of which extending outside and adjacent the bucket lip when the planar member is mounted on the bucket, the inner walls of which extending inside and adjacent the bucket lip when the planar member is mounted on the bucket whereby forming a recess for engaging the lip of the bucket in a sealed relationship.

* * * * *